US007975665B2

(12) United States Patent
Mori

(10) Patent No.: US 7,975,665 B2
(45) Date of Patent: Jul. 12, 2011

(54) SPARK PLUG AND INTERNAL COMBUSTION ENGINE PROVIDED WITH THE SAME

(75) Inventor: Kiyoteru Mori, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/312,726

(22) PCT Filed: Feb. 21, 2008

(86) PCT No.: PCT/JP2008/052943

§ 371 (c)(1),
(2), (4) Date: Sep. 15, 2009

(87) PCT Pub. No.: WO2008/102842

PCT Pub. Date: Aug. 28, 2008

(65) Prior Publication Data

US 2010/0101521 A1 Apr. 29, 2010

(30) Foreign Application Priority Data

Feb. 23, 2007 (JP) ..... 2007-043599

(51) Int. Cl.
*H01T 13/16* (2006.01)
*H01T 13/20* (2006.01)

(52) U.S. Cl. ..... 123/169 R; 123/169 C

(58) Field of Classification Search ..... 123/169 R, 123/169 EL, 169 C, 169 P, 169 E, 169 MG, 123/143 B; 313/120
See application file for complete search history.

(56) References Cited

U.S. PATENT DOCUMENTS

| | | | | | |
|---|---|---|---|---|---|
| 1,373,682 | A | * | 4/1921 | Sullivan | 313/11.5 |
| 1,527,170 | A | * | 2/1925 | Carver | 313/143 |
| 2,106,449 | A | * | 1/1938 | Boyd | 313/11.5 |
| 2,272,558 | A | * | 2/1942 | Hall | 313/11.5 |
| 2,273,651 | A | * | 2/1942 | Lude | 313/11.5 |
| 2,616,406 | A | * | 11/1952 | Thomas | 313/125 |
| 2,831,993 | A | * | 4/1958 | Lentz | 313/11.5 |
| 4,219,001 | A | * | 8/1980 | Kumagai et al. | 123/169 EL |
| 4,267,482 | A | * | 5/1981 | Iwata et al. | 313/143 |
| 4,344,014 | A | * | 8/1982 | Iwata et al. | 313/143 |

(Continued)

FOREIGN PATENT DOCUMENTS

JP 49-36344 3/1974

(Continued)

OTHER PUBLICATIONS

Int'l Search Report of PCT/JP2008/052943 (in English), dated Apr. 22, 2008; 2 pages.

*Primary Examiner* — Hai H Huynh
(74) *Attorney, Agent, or Firm* — Kusner & Jaffe

(57) ABSTRACT

A spark plug comprising a cylindrical portion which projects into a combustion chamber from an inner wall face of an engine head when the spark plug is fixed to the engine head, wherein the cylindrical portion has one or more ventilating portion comprised of a through hole or a notch in an outer circumferential face thereof. An igniting portion projecting into the combustion chamber improves ignitability. Further, because an air-fuel mixture fed from an inlet of the internal combustion engine flows to inside of the cylindrical portion through the ventilating portion, heat of an insulator is taken away and cooled down, whereby an occurrence of pre-ignition is prevented.

10 Claims, 9 Drawing Sheets

U.S. PATENT DOCUMENTS

| | | | | |
|---|---|---|---|---|
| 4,540,912 | A * | 9/1985 | Matesco | 313/142 |
| 5,105,780 | A * | 4/1992 | Richardson | 123/263 |
| 5,697,334 | A * | 12/1997 | Below | 123/169 R |
| 5,799,634 | A * | 9/1998 | Shifflette | 123/169 R |
| 5,937,813 | A * | 8/1999 | Shifflette | 123/169 V |
| 6,013,973 | A * | 1/2000 | Sato | 313/143 |
| 6,104,130 | A * | 8/2000 | Below | 313/141 |
| 6,382,159 | B1 * | 5/2002 | Shifflette | 123/169 V |
| 6,460,506 | B1 * | 10/2002 | Nevinger | 123/260 |
| 6,670,740 | B2 * | 12/2003 | Landon, Jr. | 313/141 |
| D494,136 | S * | 8/2004 | Vesecky | D13/123 |
| 6,882,092 | B1 * | 4/2005 | Nguyen | 313/141 |
| 7,770,552 | B2 * | 8/2010 | Schultz | 123/143 B |
| 2007/0119409 | A1 * | 5/2007 | Johng et al. | 123/267 |

FOREIGN PATENT DOCUMENTS

| | | |
|---|---|---|
| JP | 62-82684 | 4/1987 |
| JP | 2000-277234 | 10/2000 |
| JP | 2003-68422 | 3/2003 |

* cited by examiner

SPARK PLUG AND INTERNAL COMBUSTION ENGINE PROVIDED WITH THE SAME

FIELD OF THE INVENTION

The present invention relates to a spark plug to be mounted on an internal combustion engine so as to ignite an air-fuel mixture, and to an internal combustion engine provided with the spark plug.

BACKGROUND OF THE INVENTION

A spark plug is used for ignition for an internal combustion engine. A conventional spark plug is comprised of: a center electrode; an insulator having an axial bore for receiving the center electrode therein; and a metal shell surrounding and holding the insulator in a radial direction thereof. One end of a ground electrode is joined to the metal shell and the other end of the ground electrode forms a spark discharge gap with a front end portion of the center electrode. The spark discharge gap serves as a firing portion, and an air-fuel mixture is ignited by spark discharge.

When a firing portion of the spark plug is formed so as to project into a combustion chamber, the firing portion is kept as far away from an inner wall face of the combustion chamber which causes a flame quenching, thereby controlling a growth of flame kernel and improving ignitability. However, when the length of the ground electrode is extended in the axis direction, so that the firing portion projects into inside of the combustion chamber, a dimension to a joint portion with the metal shell, which serves as a base point of heat conduction of the ground electrode, is relatively long. As a result, thermal conductivity of the ground electrode diminishes and heat conduction property thereof deteriorates. Therefore, a failure, such as an oxidization of the entire front end side of the ground electrode, or a melting and damage of the ground electrode are likely to occur. Further, as the ground electrode is lengthened, endurance thereof over vibration, shock or the like tends to deteriorate.

Japanese Patent Application Laid-Open (kokai) No. S62-82684 discloses a spark plug in which a cylindrical portion projecting into inside of the combustion chamber from a mounting portion of the internal combustion engine is formed on a front end side of the metal shell. When the spark plug has such a configuration, wherein one end of the ground electrode is joined to the front end side of the cylindrical portion, the firing portion can project into inside of the combustion chamber without changing the length of the ground electrode in the axis direction. Compared to the case where the ground electrode is lengthened, the above-configuration can improve the ignitability of the spark plug without deterioration in thermal conductivity of the ground electrode and in endurance over vibration or the like by way of forming the firing portion to project into inside of the combustion chamber.

SUMMARY OF THE INVENTION

However, in a spark plug according to the above-identified Patent Document, a cylindrical portion of the spark plug intercepts a flow of an air-fuel mixture when the air-fuel mixture fed from an inlet of an internal combustion engine to a combustion chamber flows near an insulator. As a result, a cooling effect on the insulator is unlikely to be obtained, and an anti-pre-ignition performance tends to deteriorate. Further, when a side spark or a flashover occurs between a surface of the insulator and an inner circumferential face of the metal shell due to a fouling of the spark plug, the sparks are unlikely to be exposed to the air-fuel mixture. Thus, ignitability of the spark plug deteriorates.

The present invention is provided in view of the foregoing problems to prevent deterioration in thermal conductivity of a ground electrode and to materialize an improvement in endurance of the ground electrode. An advantage of the present invention is a spark plug capable of preventing deterioration in a cooling effect on an insulator and preventing an occurrence of flashover even though a cylindrical portion of the spark plug projects into a combustion chamber from a mounting portion of an internal combustion engine. A spark plug according to the present invention is also capable of improving an ignitability even though side sparks may occur. Another advantage of the present invention is an internal combustion engine provided with the spark plug.

According to one aspect of the present invention, a spark plug, comprising: a center electrode; an insulator having therein an axial bore that extends in an axis direction of the center electrode to accommodate the center electrode in the axial bore; a metal shell surrounding and holding the insulator in a radial direction said metal shell being mountable on a mounting portion of an internal combustion engine; a cylinder-shaped cylindrical portion formed in a front end portion of the metal shell and projecting on the front end side with respect to the mounting portion when the metal shell is mounted on the mounting portion; and a ground electrode in which one end thereof is joined to a front end of the cylindrical portion, and the other end thereof opposes one end of the center electrode to form a spark discharge gap with a front end portion of the center electrode, wherein the cylindrical portion includes one or more ventilating portions which communicates with an inside and an outside of the cylindrical portion and which is comprised of a notch.

In accordance with a first aspect of the present invention, there is provided a spark plug wherein the cylinder-shaped cylindrical portion is formed in the front end portion of the metal shell and projects on the front end side with respect to an inner face of the internal combustion engine, and the ventilating portion is comprised of a notch formed in the cylindrical portion. The ground electrode is joined to the front end of the cylindrical portion so that the spark discharge gap projects into the combustion chamber, thereby improving the ignitability. Further, when the spark discharge gap projects into the combustion chamber, it is not necessary to extend the length of the ground electrode. Thus, thermal conductivity of the ground electrode and the endurance over vibration or the like does not deteriorate. Furthermore, forming the ventilating portion in the cylindrical portion establishes a path for the air-fuel mixture flowing near the insulator through the ventilating portion, and the cooling effect on the insulator, which is produced by the flowing of the air-fuel mixture, can be obtained.

Moreover, forming the ventilating portion, a new edge (dihedral angle portion) is formed in the cylindrical portion. Since the field intensity near the edge becomes greater than that in a portion where no edge is formed, the spark discharge through the edge portion can be produced even when the spark discharge (side sparks or flashover) occurs inside of the metal shell due to a fouling of spark plug. In this situation, it is possible to remove the carbon adhering to the surface of the insulator, thereby preventing the fouling of the spark plug. Further, a reduction in the number of flashover occurrences can be achieved. When the spark discharge occurs through the edge portion, the sparks are exposed to and ignites the air-fuel mixture which flows into the cylindrical portion through the ventilating portion. Thus, a flame can be smoothly propagated into the combustion chamber through the ventilating portion. As a result, the air-fuel mixture can be stably combusted.

In accordance with a second aspect of the present invention, there is provided a spark plug wherein, in a first section including a front end portion of the cylindrical portion of the spark plug according to the first aspect and perpendicular to the axis direction, a length "W" tying both ends of the notch is preferably 0.7 L or more, where a diameter of the insulator in the first section is referred to as "L".

The ignition timing at which the pre-ignition occurs is substantially improved when a ratio W/L of the length W tying the both ends of the notch to the diameter L of the insulator is between 0.5 and 0.7. That is, when the ratio W/L is 0.7 or more, an effect of delaying the ignition timing of occurrence of the pre-ignition increases. Thus, when the length W is 0.7 or more as in the spark plug according to the second aspect of the present invention, the size of the notch is sufficient enough to improve the cooling effect. As a result, a further stable combustion of the air-fuel mixture can be achieved.

In accordance with a third aspect of the present invention, there is provided a spark plug wherein, the first section of the spark plug includes the front end portion of the cylindrical portion of the spark plug according to the first or second aspect and is perpendicular to the axis direction, the sum each of the angles formed between straight lines which connect each end of the notch to a center of the cylindrical portion, respectively, is preferably smaller than the sum each of the angles formed between straight lines which connect each end of the cylindrical portion to the center of cylindrical portion, respectively.

In this way, the sufficient air-fuel mixture can flow from the notch, thereby further improving the cooling effect on the front end portion of the insulator.

In accordance with a fourth aspect of the present invention, there is provided a spark plug wherein the diameter "L" of the insulator in the first section of the spark plug includes a front end portion of the cylindrical portion of the spark plug according to any one of the first to third aspects and is perpendicular to the axis direction is preferably shorter than the length "W" connecting both ends of the notch in the first section, and wherein a diameter "M" of the insulator in a second section including a rear end portion of the notch and perpendicular to the axis direction is longer than a length "V" connecting both ends of the notch in the second section.

In this way, since a lot of air-fuel mixture flows from the front end side of the notch, the cooling effect on the insulator by the air-fuel mixture can improve. Further, in the rear end side of the notch, since an area of the insulator that faces the cylindrical portion is large, the heat conductivity to the cylindrical portion from the insulator improves.

In accordance with a fifth aspect of the present invention, there is provided a spark plug, comprising:

a center electrode; an insulator having therein an axial bore that extends in an axis direction of the center electrode to accommodate the center electrode in the axial bore; a metal shell surrounding and holding the insulator in a radial direction and being mountable on a mounting portion of an internal combustion engine; a cylinder-shaped cylindrical portion formed in a front end portion of the metal shell and projecting from the front end side with respect to the mounting portion when the metal shell is mounted on the mounting portion; and a ground electrode in which one end is joined to a front end of the cylindrical portion and the other end opposes a front end portion of the center electrode to form a spark discharge gap with the center electrode, wherein the cylindrical portion includes one or more ventilating portions which communicate with an inside and an outside of the cylindrical portion and which comprise a through hole.

In accordance with a fifth aspect of the present invention, there is provided a spark plug wherein the same effect as a spark plug according to the first aspect of the present invention can be obtained. When the ventilating portion is comprised of the notch, the location of a junction with the ground electrode is limited. However, when the ventilating portion is comprised of the through hole as in a spark plug according to the fifth aspect of the present invention, the ground electrode can be joined to the cylindrical portion without considering the position of the ventilating portion.

In accordance with a sixth aspect of the present invention, there is provided a spark plug wherein the through hole of the spark plug according to the fifth aspect of the present invention preferably has a length in the axis direction longer than a radial length thereof.

In this way, since a lot of air-fuel mixture flows from the through hole, the cooling effect on the insulator by the air-fuel mixture can improve.

In accordance with a seventh aspect of the present invention, there is provided a spark plug wherein the ventilating portion of the spark plug according to any one of the first through sixth aspects of the present invention preferably has the radial length on the rear end side that is shorter than that on the front end side.

In this way, since a lot of air-fuel mixture flows from the front end side of the notch, the cooling effect on the insulator by the air-fuel mixture can improve. In the rear end side of the notch, since an area of the insulator that faces the cylindrical portion is large, the heat conductivity to the cylindrical portion from the insulator improves.

In accordance with an eighth aspect of the present invention, there is provided a spark plug wherein a junction between the cylindrical portion and the ground electrode of the spark plug according to any one of the first through seventh aspects of the present invention is preferably away from a position for forming the ventilating portion in a circumferential direction of the cylindrical portion.

When the cylindrical portion has the ventilating portion comprised of the through hole as in the spark plug according to the eighth aspect, the position of the ventilating portion in the cylindrical portion is preferably away from the position for forming the ground electrode in the circumferential direction of the cylindrical portion. In this way, since heat conduction from the ground electrode to the mounting portion of the internal combustion engine through the metal shell is not interrupted by the ventilating portion, the heat conductivity of the ground electrode through the cylindrical portion can improve. Further, because the ground electrode is joined at a position away from a portion of the cylindrical portion having a low rigidity due to the ventilating portion, the intensity of the ground electrode over the vibration or the like can also increase.

In accordance with a ninth aspect of the present invention, there is provided a spark plug, comprising:

a spark plug according to any one of the first to eighth aspects of the present invention; and further comprising a mounting portion to which the spark plug is fixed.

According to the internal combustion engine of the ninth aspect of the present invention, the internal combustion engine can provide the same effect as in the spark plug according to any one of the first to eighth aspects of the present invention.

In accordance with a tenth aspect of the present invention, there is provided a spark plug wherein the spark plug according to the ninth aspect preferably has the ventilating portion facing to an inlet of the internal combustion engine in a side face of the cylindrical portion when mounted on the mounting portion.

When providing the ventilating portion in the cylindrical portion, the ventilating portion is formed in a position to face toward the inlet of the internal combustion engine in the side face of the cylindrical portion. Thus, the air-fuel mixture flowing from the inlet is likely to hit the insulator and take the heat from the insulator, thereby improving the cooling effect.

DETAILED DESCRIPTION OF PREFERRED EMBODIMENT

Figure 1:
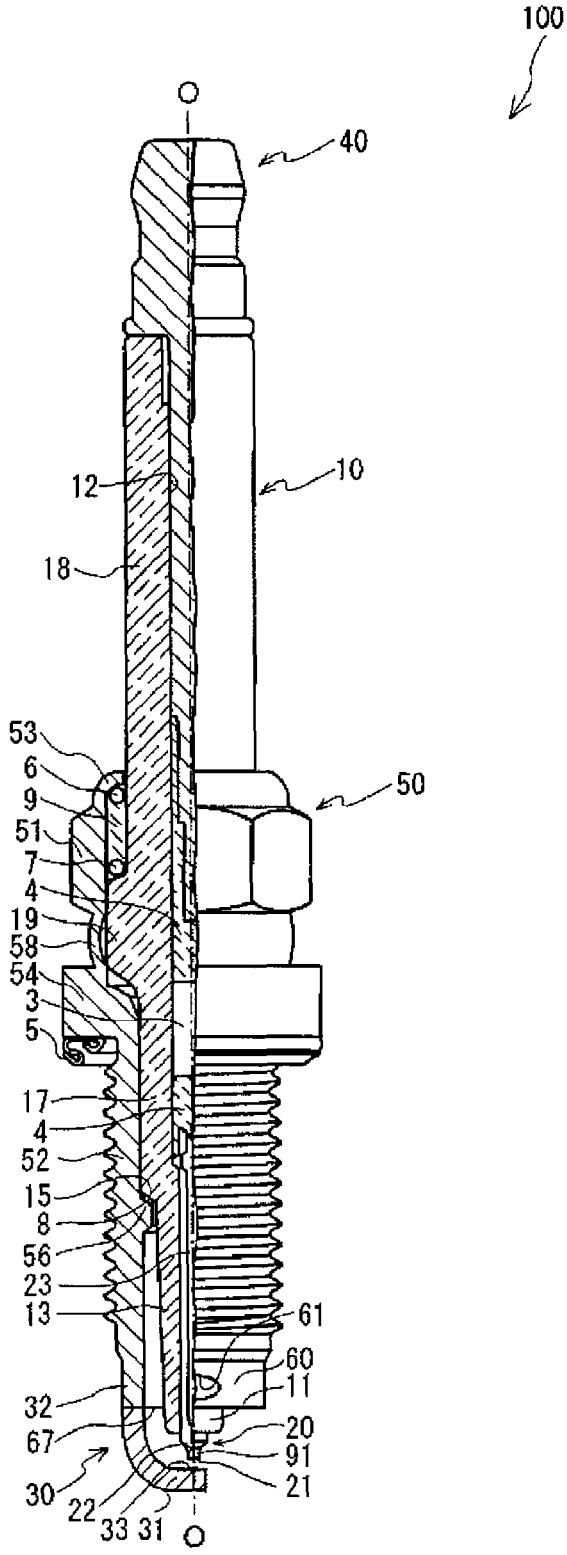
FIG. 1 is a partial cross-sectional view of a spark plug 100.

Hereafter, a first embodiment of a spark plug according to the present invention will be described with reference to the drawings. With reference to FIG. 1, a configuration of a spark plug 100 according to the first embodiment will be described. In FIG. 1, a direction of an axis "O" of the spark plug 100 is regarded as the top-to-bottom direction in the drawing. A lower side of the drawing is regarded as a front end side of the spark plug 100 and an upper side of the drawing is regarded as a rear end side of the spark plug 100.

As shown in FIG. 1, the spark plug 100 is generally comprised of an insulator 10, a metal shell 50, a center electrode 20, a cylindrical portion 60, a ground electrode 30 and a metal terminal fitting 40. The metal shell 50 holds the insulator 10 therein. The center electrode 20 extends in the axis "O" direction and is disposed in an axial bore 12 of the insulator 10. The cylindrical portion 60 is provided in a front end portion of the metal shell 50. The ground electrode 30 has a base end portion 32 welded to a front end face 67 of cylindrical portion 60. A front end portion 31 of ground electrode 30 is bent so that an inner face 33 thereof faces a front end portion 22 of the center electrode 20. The metal terminal fitting 40 is provided at a rear end portion of the insulator 10.

Insulator 10 of the spark plug 100 will now be described. The cylindrical insulator 10 is made of sintered alumina or the like as is commonly known and includes the axial bore 12 extending along an axis "O". A flange portion 19 having the largest outer diameter is formed in a generally central area in the axis "O". A rear end side body portion 18 is formed on the rear end side (upper side in FIG. 1) with respect to the flange portion 19. A front end side body portion 17 having an outer diameter smaller than that of the rear end side body portion 18 is formed on the front end side (lower side in FIG. 1) with respect to the flange portion 19. An elongated leg portion 13 having an outer diameter smaller than that of the front end side body portion 17 is formed on the front end side with respect to the front end side body portion 17. The diameter of the elongated leg portion 13 is gradually tapered towards the front end side. The elongated leg portion 13 is exposed to a combustion chamber 77 (see FIG. 3) when the spark plug 100 is mounted on an engine head 70 of an internal combustion engine 1 (see FIG. 3). Furthermore, a step portion 15 is formed between the elongated leg portion 13 and the front end side body portion 17.

Center electrode 20 will now be described. The center electrode 20 assumes a generally columnar shape and is made of nickel-system alloys or the like such as INCONEL (trade name) 600 or 601 in which a metal core 23 comprised of copper or the like with excellent thermal conductivity is provided. The center electrode 20 is held in the front end side of the axial bore 12 of the insulator 10 so that an axis of the center electrode 20 is coaxially-arranged with the axis O of the spark plug 100. A front end side of the center electrode 20 projects from a front end face of a front end portion 11 of the insulator 10. The projecting front portion is tapered towards the front end side. A noble metal tip 91 for improving resistance to spark erosion is welded to a front end of the projecting front portion and integrated with the center electrode 20 so as to constitute the front end portion 22 having small diameter. In the first embodiment, the "center electrode" includes the noble metal tip 91 integrated with the center electrode 20.

The center electrode 20 is electrically connected to the metal terminal fitting 40 on the rear end side through a seal material 4 and a ceramic resistance 3 both provided inside the axial bore 12. A high-tension cable (not shown) is connected to the metal terminal fitting 40 through a plug cap (not shown) where high voltage is applied.

Next, the ground electrode 30 will be described. The ground electrode 30 is comprised of a metal having an excellent corrosion resistance, such as by way of example and not limitation, a nickel-system alloy such as INCONEL (trade name) 600 or 601. The ground electrode 30 has a generally rectangular shape as seen from the cross-section in the longitudinal direction. The base end portion 32 of the ground electrode 30 is welded to the front end face 67 of the cylindrical portion 60. The front end portion 31 of the ground electrode 30 is bent so that one side face thereof faces the front end portion 22 of the center electrode 20 whereby a spark discharge gap is formed between the inner face 33 of the front end portion 31 and a front end face 21 of the center electrode 20 (the front end face 21 of the noble metal tip 91 in the first embodiment).

Next, the metal shell 50 will be described. The metal shell 50 is a tubular metal fitting for fixing the spark plug 100 to the engine head 70 (see FIG. 2) of the internal combustion engine 1 (see FIG. 3). and the metal shell 50 holds and surrounds the insulator 10 therein. The metal shell 50 is comprised of a low carbon steel material and includes a tool engagement portion 51 and a fitting thread portion 52. The tool engagement portion 51 engages with a spark plug wrench (not shown). The fitting thread portion 52 assumes a male-thread shape to engage with a mounting portion 71 (refer to FIG. 2) of the engine head 70 provided in the upper part of the internal combustion engine 1. A flange-like seal portion 54 is formed between the tool engagement portion 51 and the fitting thread portion 52, and a gasket 5 for preventing air leakage in the engine is formed between the seal portion 54 and the fitting thread portion 52.

A thin caulking portion 53 is formed on the rear end side with respect to the tool engagement portion 51 of the metal shell 50, and a thin buckling portion 58 is formed between the seal portion 54 and the tool engagement portion 51. Annular ring members 6, 7 lie between an inner circumferential face of the metal shell 50 where the tool engagement portion 51 and the caulking portion 53 are formed and an outer circumferential face of the rear end side body portions 18 of the insulator 10. Talc powder 9 is filled between both ring members 6, 7. The insulator 10 is pressed towards the front end side in the metal shell 50 through the ring members 6, 7 and the talc 9 by inwardly caulking an end portion of the caulking portion 53. A step portion 56 formed in an inner circumference of the metal shell 50 and corresponding to the fitting thread portion 52 supports the step portion 15 of the insulator 10 through an annular packing 8, thereby integrating the metal shell 50 and the insulator 10. At this time, the air tightness between the metal shell 50 and the insulator 10 is maintained by the packing 8. The buckling portion 58 is formed so as to outwardly deform with an application of compression force at the time of a caulking process. The buckling portion 58 provides a compression stroke of the talc 9 in order to improve the air tightness.

Figure 2:
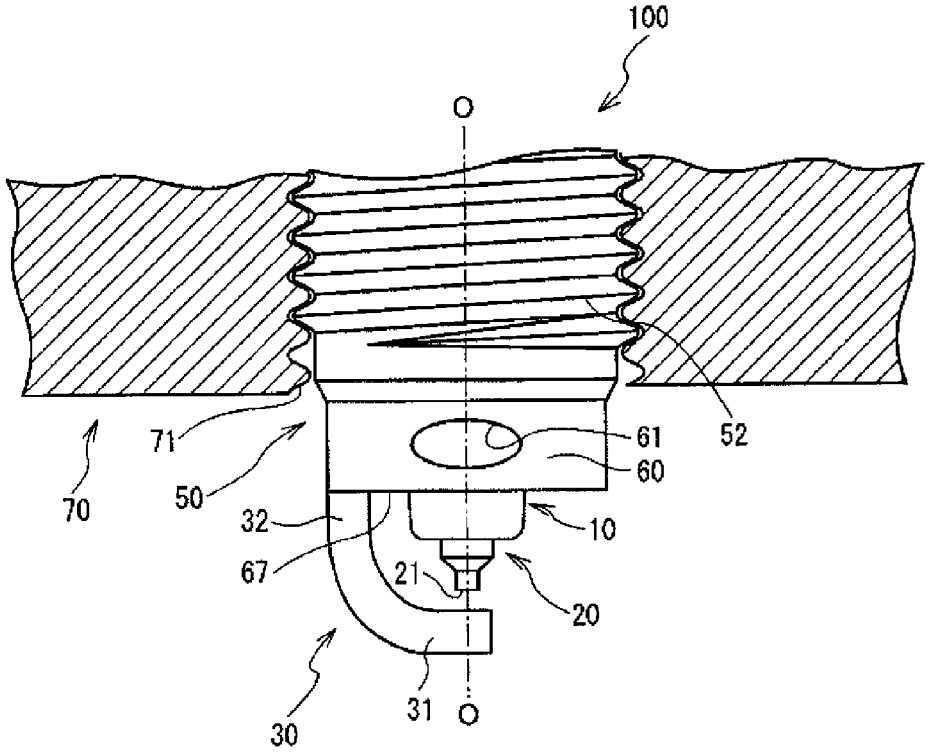
FIG. 2 is an expanded side view showing a vicinity of a spark discharge gap of the spark plug 100 mounted on a mounting portion 71.

Referring now to FIG. 2, the cylindrical portion 60 formed at the front end portion of the metal shell 50 will be described. As shown in FIG. 2, the cylinder-shaped cylindrical portion 60 is provided at the front end portion of the metal shell 50. The cylindrical portion 60 projects into the combustion chamber from an inner wall face of the engine head 70 when the spark plug 100 is fixed to the mounting portion 71 of the engine head 70. The cylindrical portion 60 is formed so that the front end face 67 is disposed on the rear end side with respect to the front end face 21 of the center electrode 20. As aforementioned, the base end portion 32 of the ground electrode 30 is joined to the front end face 67 of the cylindrical portion 60. Further, a ventilating portion 61, comprised of a through hole that penetrates a side face of an inner circumference of the cylindrical portion 60, is formed on a side face of an outer circumference of the cylindrical portion 60. The ventilating portion 61 assumes an oval shape having a minor axis in a direction parallel to the axis O. When the ventilating portion 61 is seen in a radial direction, a major axis of the ventilating portion 61 is 3.0 mm, the minor axis thereof is 1.5 mm. The ventilating portion 61 is formed at a location spaced from a junction between the cylindrical portion 60 and the ground electrode 30 in a circumferential direction of the cylindrical portion 60. It is noted that the circumferential direction of the cylindrical portion 60 is a direction perpendicularly to the axis O direction.

Figure 3:
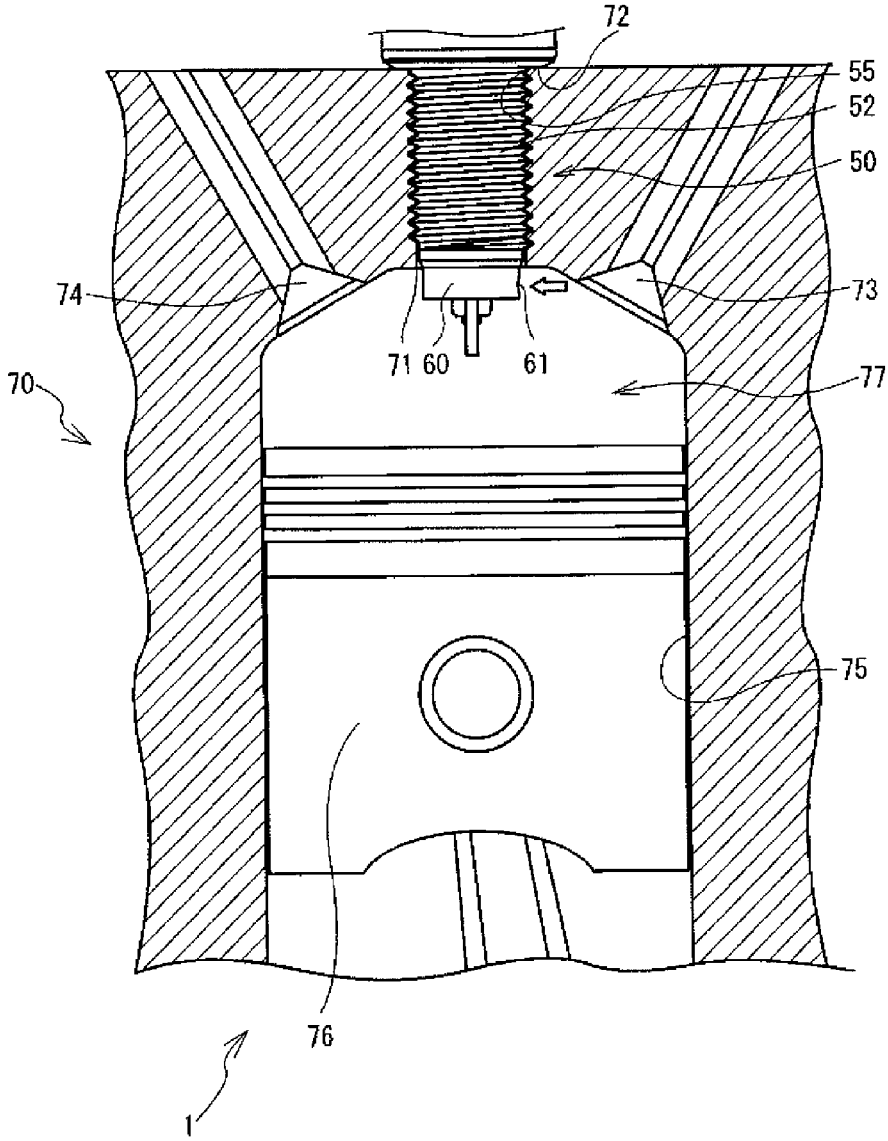
FIG. 3 is a partially fractured cross-sectional view showing a state where the spark plug 100 is mounted on the mounting portion 71 of an engine head 70.

Referring now to FIG. 3, the positional relation between a formation position of the ventilating portion 61 of the spark plug 100 mounted on the engine head 70 and an inlet 73 of the internal combustion engine 1 will be described. As shown in FIG. 3, in the internal combustion engine provided with a piston 76 which moves up and down along an axis direction of a cylinder 75, a path is established from where the air-fuel mixture fed from the inlet 73 into the combustion chamber 77 flows to an exhaust port 74. In the spark plug 100 mounted on the mounting portion 71, the cylindrical portion 60 of the metal shell 50 and the spark discharge gap are disposed along the path. Further, a thread starting position 55 formed on the fitting thread portion 52 of the metal shell 50 is brought into contact with a contact position 72 of the mounting portion 71 at the time of fixing the spark plug 100. A relative direction (angular phase) between the engine head 70 and the spark plug 100 after tightening the spark plug 100 is determined by specifying the starting position 55 and the contact position 72. When the spark plug 100 is fixed to the mounting portion 71 of the engine head 70, the ventilating portion 61 is formed to be positioned facing to the inlet 73 of internal combustion engine 1 (right-hand side in FIG. 3) in the outer circumferential face of the cylindrical portion 60. It is noted that a fixing method of the spark plug 100 to the engine head 70 at the angular phase after tightening is one of the examples and is not limited to the above method.

According to the spark plug 100 of the first embodiment, the air-fuel mixture flowing into the combustion chamber from the inlet 73 enters the cylindrical portion 60 through the ventilating portion 61 and hits the surface of the insulator 10 facing the ventilating portion 61. Thus, the air-fuel mixture takes heat from the insulator 10 and cools it down. Therefore, a pre-ignition failure is likely to be prevented. On the other hand, the cylindrical portion 60 prevents the air-fuel mixture from directly hitting a surface of the insulator 10 which does not face the ventilating portion 61. When the amount of the air-fuel mixture hitting the surface of the insulator 10 is suitably adjusted by the cylindrical portion 60, carbon adhering to the surface of the insulator 10 can be reduced, thereby preventing an occurrence of so-called "carbon fouling".

Furthermore, since the ventilating portion 61 is formed in the position away from the junction between the ground electrode 30 and the cylindrical portion 60 in the circumferential direction of the cylindrical portion 60, the ground electrode 30 can be attached at a position that is away from a portion of the cylindrical portion 60 that has low rigidity due to the ventilating portion 61. Therefore, the endurance over vibration or a shock can improve. In addition, since heat transfer from the ground electrode 30 to the rear end side of the metal shell 50 is not intercepted by the ventilating portion 61, heat conductivity of the ground electrode 30 through the cylindrical portion 60 can improve. When the spark plug 100 is mounted on the internal combustion engine 1, the ventilating portion 61 is formed in the outer circumferential face of the cylindrical portion 60 at a position facing the inlet 73 of the internal combustion engine 1. Thus, the air-fuel mixture is likely to hit the insulator 10 through the ventilating portion 61, thereby facilitating a cooling effect.

Next, a configuration of a spark plug 200 according to a second embodiment of the present invention will be described with reference to FIG. 4. The spark plug 200 according to the second embodiment is provided with a ventilating portion 261 having a different shape from the ventilating portion 61 of the spark plug 100 according to the first embodiment. Thus, only the shape of ventilating portion 261 provided in a cylindrical portion 260 of a metal shell 250 of the spark plug 200 will be described. Other parts or portions of the spark plug 200 that are the same as those in the first embodiment will be represented with the same reference numerals, and the description thereof shall be omitted or simplified.

Figure 4:
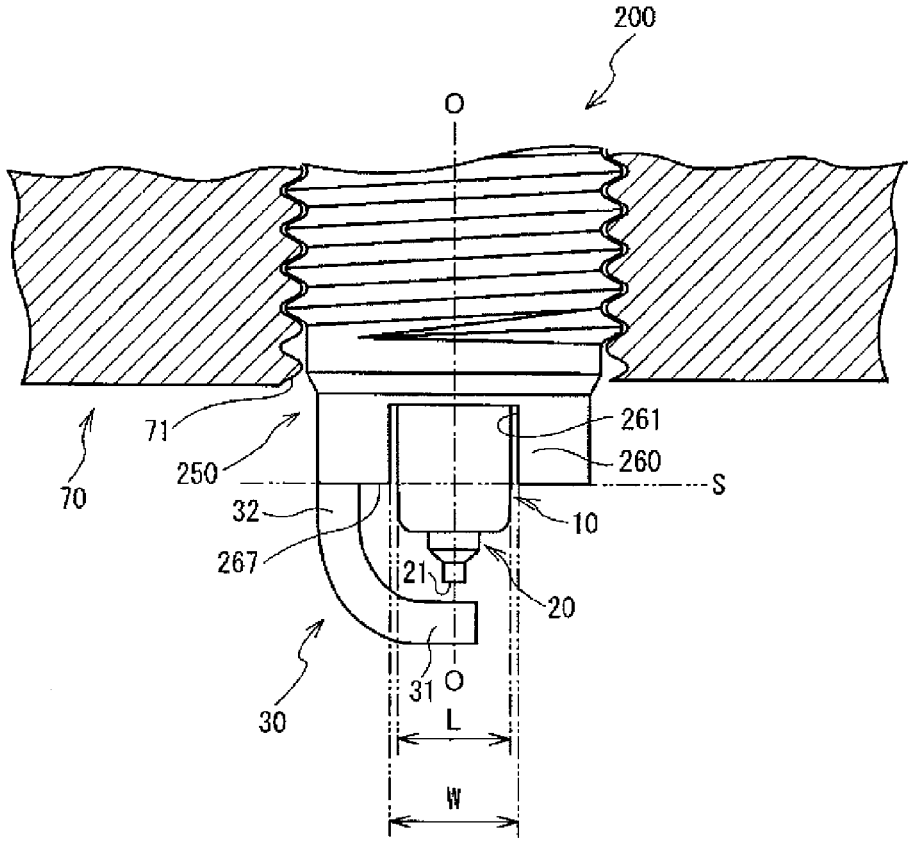
FIG. 4 is an expanded side view showing a vicinity of a spark discharge gap of a spark plug 200 mounted on the mounting portion 71 according to a second embodiment.

As shown in FIG. 4, similar to the metal shell 50 of the first embodiment, the cylindrical portion 260 is provided in the front end portion of the metal shell 250 of the spark plug 200 according to the second embodiment. When the spark plug 200 is mounted on the mounting portion 71 of the engine head 70, the cylindrical portion 260 projects into the combustion chamber from the inner wall face of the engine head 70. The base end 32 of the ground electrode 30 is joined to a front end face 267 of the cylindrical portion 260. In the cylindrical portion 260, the U-shaped notch 261 is formed in a side view having a size of 2.5 mm high (a direction parallel to the axis O) and 5.0 mm wide at a position away from the junction between the ground electrode 30 and the cylindrical portion 260 in the circumferential direction of the cylindrical portion 260. An edge (dihedral angle portion) formed between a face forming the ventilating portion 261 and the inner circumferential face of the cylindrical portion 260 is not R-chamfered and has a sharp angle. Similar to the ventilating portion 61 of the spark plug 100 according to the first embodiment, when the spark plug 200 is fixed to the mounting portion 71 of the engine head 70, the ventilating portion 261 is formed on a side (right-hand side in FIG. 3) facing to the inlet 73 of the internal combustion engine 1 (see FIG. 3) in the outer circumferential face of the cylindrical portion 260. Further, in the spark plug 200, another ventilating portion 261 is formed on a side (left-hand side in FIG. 3) facing to the exhaust port 74 (see FIG. 3) of the internal combustion engine 1 in the outer circumferential face of the cylindrical portion 260.

In the spark plug 200 having such a configuration, the air-fuel mixture enters into the combustion chamber 77 from the inlet 73 at the time of driving the internal combustion engine 1 and flows toward the exhaust port 74. At this time, the air-fuel mixture enters into the inside of cylindrical portion 260 through the ventilating portion 261 of the cylindrical portion 260, that is disposed in a flowing path of the air-fuel mixture, and hits the surface of the insulator 10 facing to the ventilating portion 261. Thus, the air-fuel mixture removes heat from the insulator 10 and cools down the insulator 10. Since the angle of the edge formed between the face forming the ventilating portion 261 and the inner circumferential face of the cylindrical portion 260 is sharp, field intensity near the edge becomes large by forming the ventilating portion 261. Further, even when a side spark is generated due to a fouling of the spark plug 200, the flashover produced at the rear end side of the elongated leg portion 13 of the insulator 10 can be prevented because the spark flies to the edge. Then, the carbon adhering to the surface of the insulator 10 can be cleaned. Since the air-fuel mixture flows into the inside of the cylindrical portion 260 through the ventilating portion 261, the sparks tend to be exposed to the air-fuel mixture when the sparks fly to the edge of the ventilating portion 261, thereby readily igniting the air-fuel mixture. Furthermore, the flames can be smoothly propagated into the combustion chamber 77 through the ventilating portion 261.

In order to verify the effect of the embodiments, the spark plugs configured according to the above embodiments are subject to evaluation tests 1 to 3 as shown below.

First Embodiment

First, as an evaluation test 1, a test on a relation between the presence/absence of the ventilating portion 61, 261 and an occurring timing of the pre-ignition was conducted. In the evaluation test 1, three spark plugs A, B and C each having different shape of the cylindrical portion that was provided in the front end portion of the metal shell were prepared. Spark plug A had no ventilating portion in the cylindrical portion. Spark plug B had an oval-shaped through hole in the cylindrical portion which is similar to the spark plug 100 according to the first embodiment. Spark plug C had a U-shaped notch in the cylindrical portion which is similar to the spark plug 200 according to the second embodiment. Then, each spark plug was mounted on the engine head of an internal combustion engine The engine was operated in a full-throttle state at 5600 rpm of engine speed, and the ignition timing was gradually advanced to cause the pre-ignition. Then, an ignition timing where the earliest pre-ignition occurred and an ignition timing where the latest pre-ignition occurred were measured. It is noted that the ignition timing is represented as an angle before top-dead center (BTDC) of a crank, which moves a piston in the internal combustion engine. As the ignition timing where the earliest pre-ignition occurred and the ignition timing where the latest pre-ignition occurred were late—i.e., as the degree of BTDC was large—the spark plug had good heat conductivity and a higher thermal value. That is, as the ignition timing advances, a combusting period is long and the temperature of the insulator is likely to rise. The result of evaluation test 1 is shown in Table 1. In Table 1, "Δ" shows the ignition timing when the earliest pre-ignition occurs, and "▲" shows the ignition timing when the latest pre-ignition occurs.

TABLE 1

| | Ignition Timing (BTDC [Degree]) | | | | | | | | | | |
|---|---|---|---|---|---|---|---|---|---|---|---|
| | 30 | 31 | 32 | 33 | 34 | 35 | 36 | 37 | 38 | 39 | 40 |
| Spark Plug A with no Ventilation | | | | | Δ | ▲ | | | | | |
| Spark Plug B with ϕ 1.5-3.0 Through-Hole | | | | | | Δ | ▲ | | | | |
| Spark Plug C with W5.0-H2.5 Notch | | | | | | | Δ | ▲ | | | |

Δ: Earliest Pre-ignition
▲: Latest Pre-ignition

As shown in Table 1, according to the result of evaluation test 1, spark plug B exhibited that both ignition timings where the earliest and latest pre-ignitions occur were late compared to those of spark plug A, and the spark plug B had good heat conductivity. Compared to spark plugs A and B, spark plug C exhibited that the ignition timings where the earliest and latest pre-ignitions occur were later, and spark plug C had better heat conductivity. The reason why spark plug C had better heat conductivity than that of spark plug B was that spark plug C had a ventilating portion larger than that of spark plug B.

Second Embodiment

Figure 5:
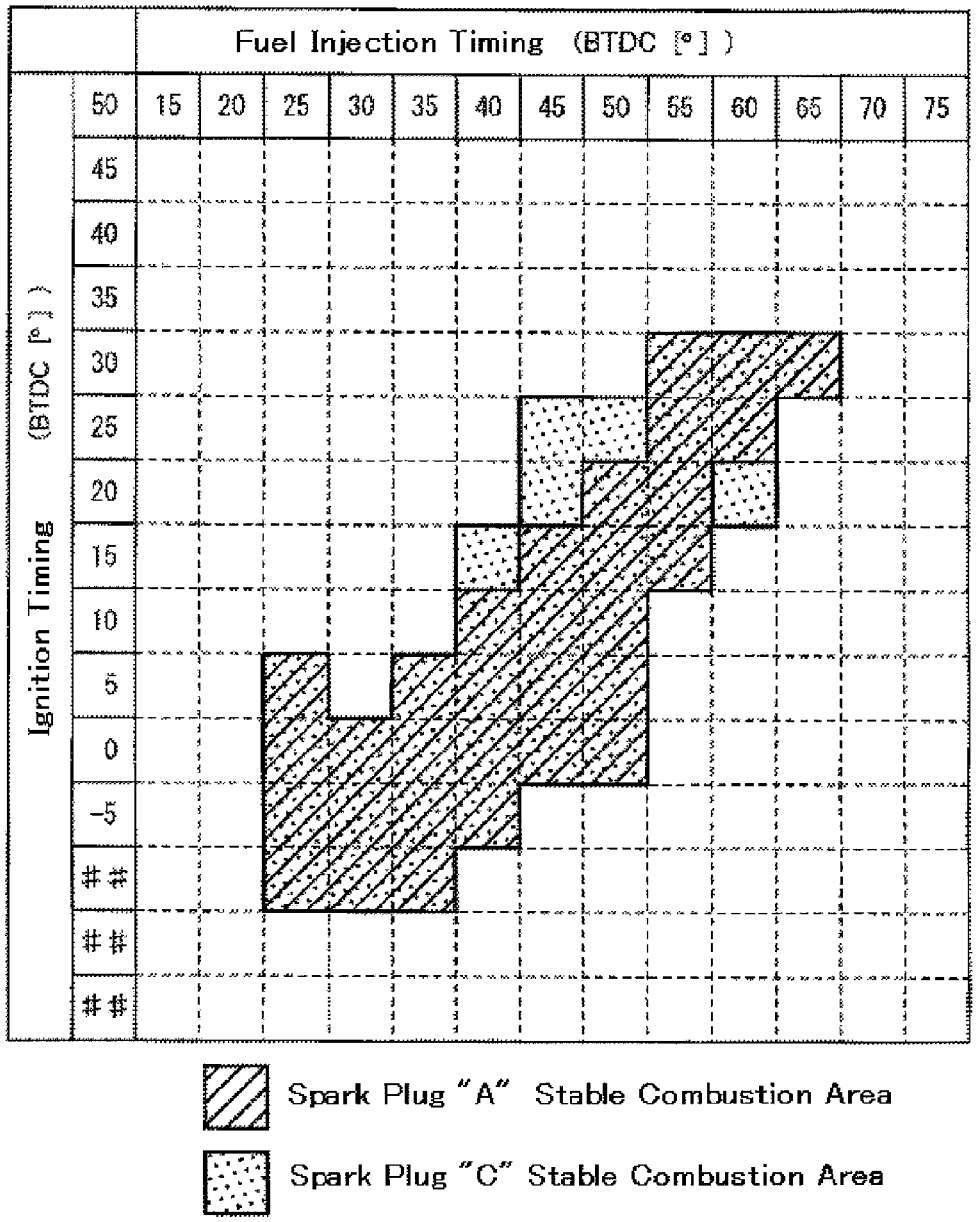
FIG. 5 is a graph showing a result of evaluation test 2 on a relation between presence/absence of a ventilating portion and a combustion stability.

Next, as an evaluation test 2, a test on a relation between the presence/absence of the ventilating portion 261 and a combustion stability was conducted. In the evaluation test 2, the same spark plugs A and C as the first embodiment were prepared. Each spark plug was mounted on the engine head of the internal combustion engine for the test. The internal combustion engine was operated at different fuel injection timing and ignition timing. The combustion stability was then examined as to whether or not any misfiring occurred. The result is shown in FIG. 5. In FIG. 5, both the ignition timing and the fuel injection timing are represented as an angle before top-dead center (BTDC) of a crank. An area shaded with lines shows the stable combustion area of spark plug A, and an area shaded with dots shows the stable combustion of spark plug C. In FIG. 5, as the angle BTDC of the crank shown on a horizontal axis became smaller, the fuel injection timing was late. Further, as the angle BTDC of the crank shown on a vertical axis became large, the ignition timing advanced. Therefore, as it reaches to the upper left in the graph shown in FIG. 5, the period of time from the fuel injection to the ignition becomes shorter. As a result, the atomized fuel tends to be insufficient in the air-fuel mixture whereby the so-called "carbon fouling" is likely to occur.

As shown in FIG. 5, according to the result of the evaluation test 2, it was confirmed that spark plug C had a large stable combustion area compared to that of spark plug A. In particular, spark plug C exhibited an increased stable combustion area near the upper left in FIG. 5 where the carbon fouling tends to occur, compared to spark plug A. This is because the sparks fly to the edge, which is provided by forming the ventilating portion in the cylindrical portion, and ignites the air-fuel mixture even though the side sparks are generated.

Third Embodiment

Figure 6:
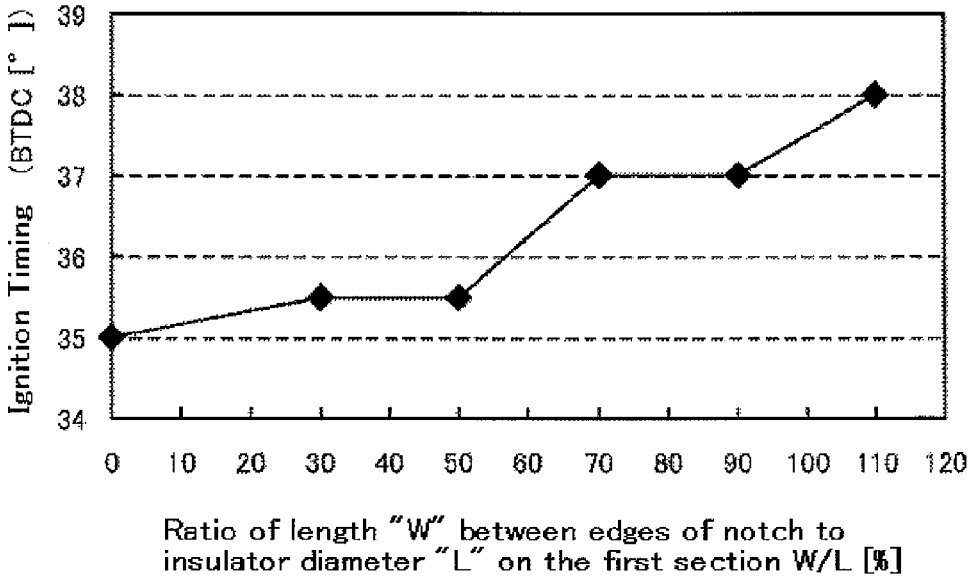
FIG. 6 is a graph showing a result of evaluation test 3 on a relation between a presence/absence of the ventilating portion and the combustion stability.

Next, as an evaluation test 3, a test on a relation between a ratio W/L (%) of a notch width W to a diameter L of the insulator in a first virtual section and the occurrence timing of the pre-ignition was conducted. Here, the first virtual section, the diameter L of the insulator in the first virtual section and the notch width W will be described using the spark plug 200 in FIG. 4 as an example. In FIG. 4, the first virtual section S is a cross section that is perpendicular to the axis O direction, and that includes the front end portion of the cylindrical portion. In FIG. 4, the diameter of the insulator 10 in the first virtual section S is shown as "L", and a length tying both ends of the ventilating portion 261 (notch) in the first virtual section S is shown as "W". In the evaluation test 3, "W" and "L" were defined as mentioned above, and six spark plugs each having a different ratio W/L (%) were prepared. More particularly, the similar test as the evaluation test 1 was conducted on the spark plugs each having the ratio W/L (%) of 0% (with no notch), 30%, 50%, 70%, 90% and 110%. The result of the evaluation test 3 is shown in FIG. 6. In FIG. 6, the ignition timing when the pre-ignition occurs is represented as the angle BTDC of the crank.

As shown in FIG. 6, according to the result of evaluation test 3, as the ratio W/L (%) increased, the angle (BTDC) of the crank became greater compared to the case where the ratio W/L (%) was less, and good heat conductivity was exhibited. In particular, the angle (BTDC) of the crank was sharply increased between the ratio W/L (%) of 50% and 70(%). When the ratio W/L was 70(%) or more, the notch could exhibit a further large effect.

The present invention is not particularly limited to the embodiments described above, but may be changed or modified in various ways. For example, a modification shown below may be adequately added. Hereafter, the modification of the above-mentioned embodiment will be described with reference to FIGS. 7 to 10. In FIGS. 7 to 10, similar parts and portions of the modification to that of the first and second embodiments will be represented by the same reference numerals, and the descriptions thereof will be omitted or simplified.

Figure 7:
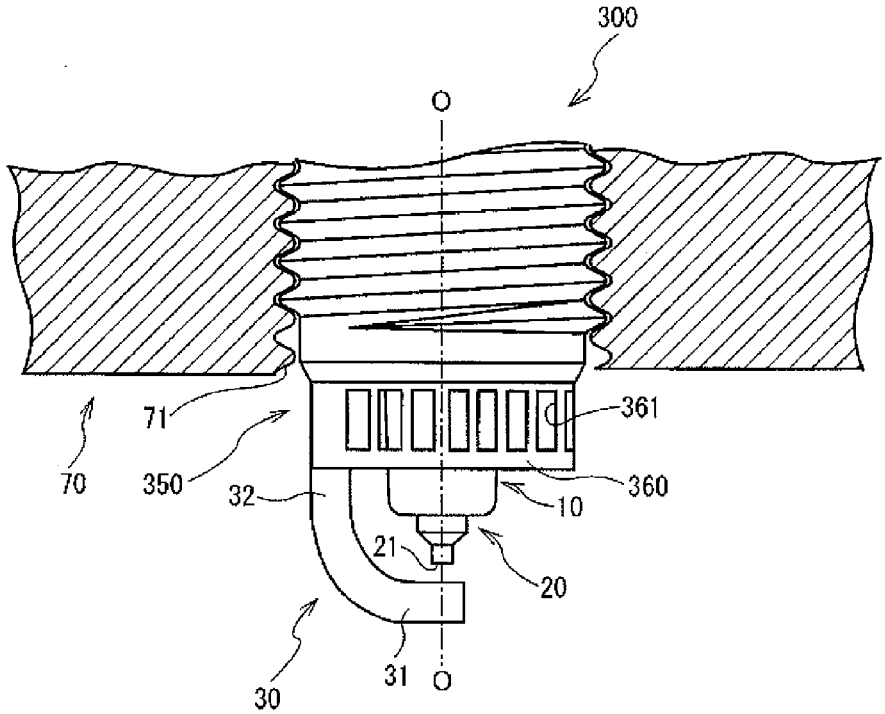
FIG. 7 is an expanded side view showing a vicinity of a spark discharge gap of a spark plug 300 mounted on the mounting portion 71.

A first modification as shown in FIG. 7 has different shape and a different number of the ventilating portions, which are formed in the cylindrical portion provided in the front end portion of the metal shell, compared to that of the first embodiment. Other components of the first modification are the same as that of the first embodiment. More particularly, as shown in FIG. 7, a sparkplug 300 according to the first modification has eight ventilating portions 361 formed in the cylindrical portion 360 of the metal shell 350. Ventilating portions 361 assume a rectangular, through-hole shape in the axis O direction with the size of 2.5 mm high (in the direction parallel to the axis O) and 1.0 mm wide. Since a ventilating portion 361 has a length in the axis O direction longer than a radial length thereof in the first modification, a lot of air-fuel mixture can flow from the ventilating portion 361. As a result, the cooling effect on the insulator 10 improves. Similar to the first modification, a plurality of ventilating portions comprised of a through hole or a notch may be employed. The ventilating portions are preferably provided in a position facing to at least the inlet of the internal combustion engine. Therefore, similar to the spark plug 200 (refer to FIG. 4) of the second embodiment, in the outer circumferential face of the cylindrical portion, the ventilating portion may be provided not only in a position facing to the inlet of the internal combustion engine but also in a position facing to the exhaust port of the internal combustion engine. In this way, the air-fuel mixture can flow near the insulator through the ventilating portion, thereby exerting the cooling effect on the insulator by the air-fuel mixture.

Figure 8:
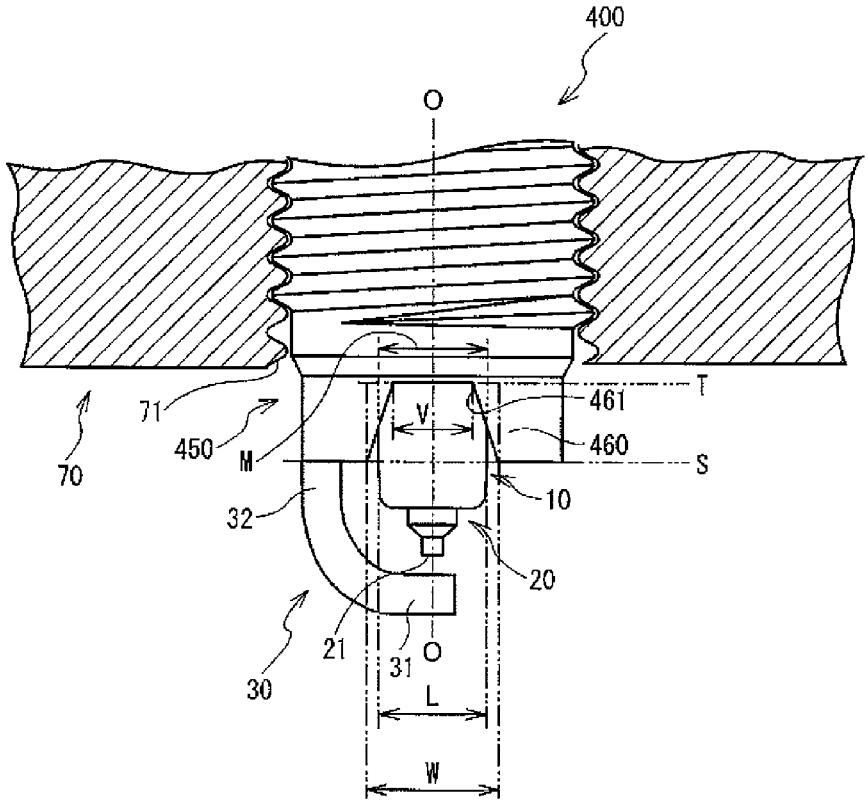
FIG. 8 is an expanded side view showing a vicinity of a spark discharge gap of a spark plug 400 mounted on the mounting portion 71.

Next, a second modification as shown in FIG. 8 has a different shape of the ventilating portion provided in the cylindrical portion of the metal shell compared to that of the second embodiment. Other components of the second modification are the same as that of the second embodiment. A spark plug 400 according to the second modification has a ventilating portion 461 in which a radial length thereof on the rear end side is shorter than that on the front end side. More particularly, as shown in FIG. 8, a cylindrical portion 460 provided in the front end portion of a metal shell 450 includes a ventilating portion 461 (notch) that assumes a generally trapezoidal shape in the side view with the size of 2.5 mm high (in a direction parallel to the axis O), 5.0 mm width on the front end side and 3.0 mm width on the rear end side. In this way, the shape and the size of ventilating portion comprised of a through hole or a notch can be adequately altered. When the ventilating portion is formed in a notch shape, the notch in the side view preferably has the radial length on the rear end side shorter than that on the front end side as in spark plug 400. Further, as in spark plug 400, a diameter "L" of the insulator 10 in a first virtual section "S," that includes the front end portion and perpendicular to the axis O direction, is preferably shorter than a length "W" tying both ends of the ventilating portion 461 in the first virtual section S. Also, a diameter "M" of the insulator 10 in a second virtual section "T," that includes the rear end portion of a ventilating portion 461 and that is perpendicular to the axis O direction, is preferably longer than a length "V" tying both ends of the ventilating portion 461 in the second virtual section T. In this way, since a lot of air-fuel mixture flows from the front end side of the ventilating portion 461, the cooling effect on the insulator 10 by the air-fuel mixture can improve. Furthermore, since an area of the insulator 10 that faces the cylindrical portion is large on the rear end side of the ventilating portion 461, the heat conductivity to the cylindrical portion from the insulator 10 can improve. A shape of the ventilating portion where the radial length thereof on the rear end side is shorter than that on the front end side can be arbitrary selected. For example, a triangular shape or a droplet shape can be adopted besides the generally trapezoidal shape in the side view according to the second modification.

When providing the ventilating portion comprised of the notch, an area where the ventilating portion (notch) is formed is preferably smaller than an area where no notch is formed, viewing the cylindrical portion from the front end side. In other words, in the first virtual section S perpendicular to the axis O direction, the sum of the angles each formed between straight lines which tie each end of the notch to the center of cylindrical portion, respectively, is preferably smaller than the sum of the angles each formed between straight lines which tie each end of the cylindrical portion to the center of cylindrical portion, respectively. Using the spark plug 200 shown in FIG. 4 as an example, the angle formed between the straight lines which tie each end of the notch to the center of cylindrical portion, respectively, and the angle formed between the straight lines which tie each end of the cylindrical portion to the center of cylindrical portion, respectively, in the first virtual section S perpendicular to the axis O direction will be described with reference to FIG. 9. The center of the cylindrical portion 260 is referred to as "P" in FIG. 9. An angle "α" shows the angle formed between the straight lines tying each end of the cylindrical portion 260 to the center P, respectively, in the first virtual section S. Thus, the angle formed between the straight lines tying each end of the cylindrical portion 260 to the center P, respectively, in the first virtual section S means an angle facing to the cylindrical portion 260 among the angles formed between the straight lines which tie each end to the center P of cylindrical portion 260, respectively, in the first virtual section S. Similarly, in FIG. 9, an angle "β" represents the angle formed between the straight lines which tie each end of the notch 261 to the center P, respectively, in the first virtual section S. The angle β is an acute angle, and the sum of angles β is smaller than the sum of angles α. Thus, when a formation range of the cylindrical portion 260 and that of the notch 261 in the first virtual section S are specified, sufficient air-fuel mixture can flow from the notch 261, thereby further improving the cooling effect on the front end portion of the insulator 10.

Similar to spark plug 200, the angle β may differ depending on whether the both ends of notch 261 in the first virtual section S are defined as the ends on the inner circumference side or the outer circumference side of the notch 261. The reason for specifying the above-mentioned formation range of the cylindrical portion 260 and that of the notch 261 in the first virtual section S is that the sufficient air-fuel mixture can flow into the center P through the notch 261. Therefore, the definition of the "both ends" of the notch 261 can be selected considering the flow of the air-fuel mixture. The both ends can be defined either the ends on the inner circumference side or the outer circumference side of the notch 261, or alternatively a combination thereof (i.e., one end is on the inner circumference side and the other end is on the outer circumference side of the notch 261). The same idea may be adapted to the "both ends" of cylindrical portion.

Figure 9:
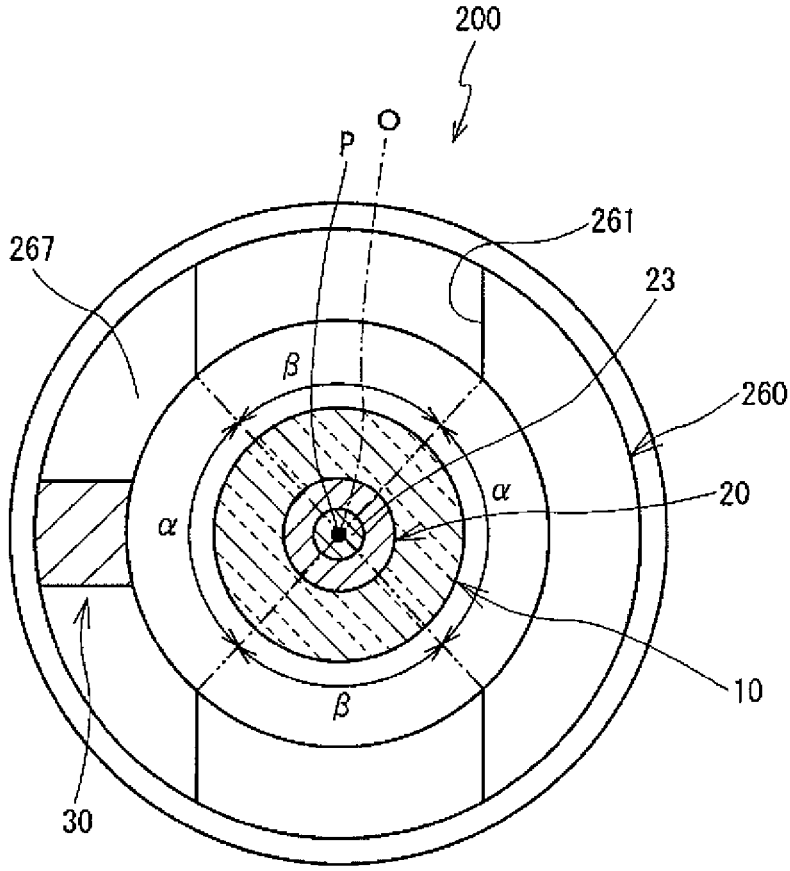
FIG. 9 is a cross-sectional view showing the spark plug 200 on a first virtual section S that is perpendicular to an axis O, seeing from a front side in an axis O direction.
Figure 10:
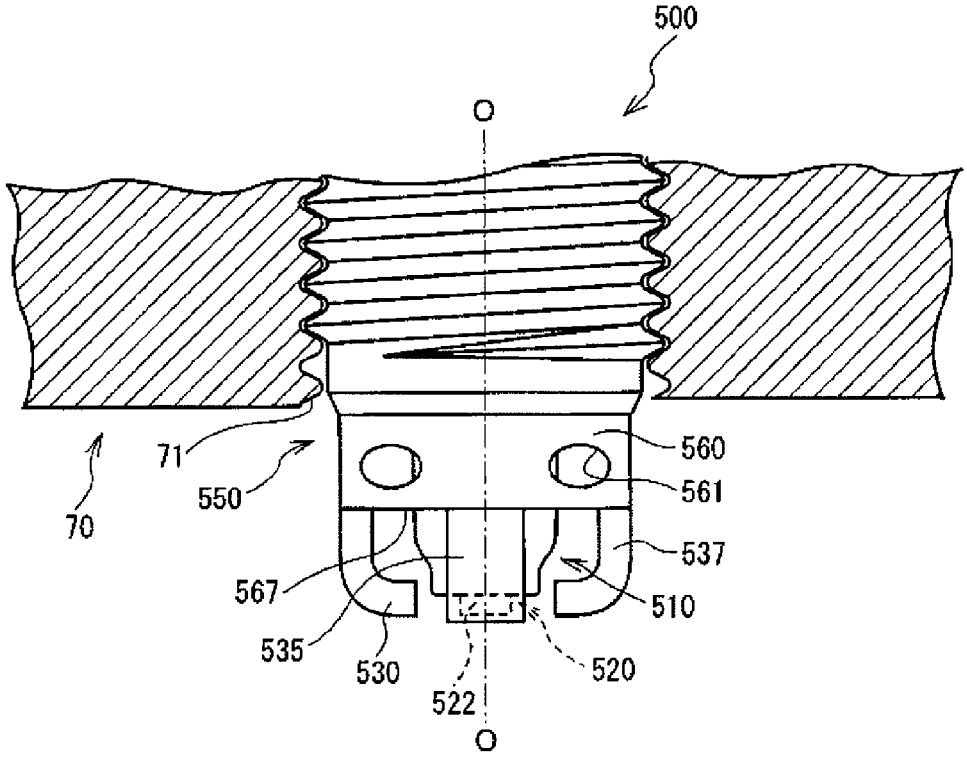
FIG. 10 is an expanded side view showing a vicinity of a spark discharge gap of a spark plug 500 mounted on the mounting portion 71.

Next, in a modification 3 as shown in FIG. 10, shapes of the ventilating portion, the front end side of insulator and the front end side of the center electrode, and the number of ground electrodes are different from those in the first embodiment. Other components of the modification 3 are the same as that of the first embodiment. More particularly, a spark plug 500 according to modification 3, as shown in FIG. 9, four ground electrodes all of which have the same shape and size are joined to a front end face 567 of a cylindrical portion 560 that is provided in the front end portion of a metal shell 550. In detail, a ground electrode 530 is provided on the left-hand side in FIG. 10, a ground electrode 535 is provided on the near side, a ground electrode 537 is provided on the right-hand side and another ground electrode (not illustrated) is provided on the far side, respectively. The spark discharge gap is formed between a front end portion 522 of a center electrode 520, which is held in an insulator 510, and the four ground electrodes, respectively. In the outer circumferential face of the cylindrical portion 560 in the spark plug 500, there is provided two oval-shaped ventilating portions 561 with the size of 2.0 mm in the major axis and 1.5 mm in the minor axis (a direction parallel to the axis O). In this way, the present invention can also be applied to a multi-ground-electrodes plug. The shape, size and a number of the ventilating portion can be defined arbitrarily.

In the first embodiment, as shown in FIG. 3, the angle phase after fixing the spark plug 100 to the mounting portion 71 is defined by specifying the thread starting position 55 and the contact position 72. However, other methods for defining the angle phase after fixing the spark plug 100 can also be employed. For example, there is a method using so-called a thread-less plug that has no thread ridge in the metal shell. Such a thread-less plug is mounted on the internal combustion engine in such a manner that the plug is inserted in a mounting hole formed in the internal combustion engine while pressing towards the front end side with a fixing tool, and then the fixing tool is fixed to the engine head by a screw clamp or the like. When using the thread-less plug, an adequate angle phase can be readily determined at the time of inserting the plug in the mounting hole.

Although the thread is not formed in the cylindrical portion 60 in the first embodiment, the thread portion 52 may be further extended in the axis O direction so that a part of the thread portion 52 projects from the inner wall face of the engine head 70 when mounting the spark plug on the engine head 70. That is, even though the spark plug has the thread ridge formed in the cylindrical portion 60 thereof, the present invention is applicable. In the first and the second embodiment, although the spark plug is fixed perpendicularly to the inner wall face of the engine head 70, the present invention is applicable to a spark plug which is fixed aslant to the inner wall face.

Although the above embodiments and modifications carrying out the present invention exhibits the cylindrical portion having the ventilating portion with the same shape at an equal interval therebetween, the present invention is not necessarily limited to the above-described embodiments and modifications. The size of the ventilating portion formed in the cylindrical portion may vary. As described above, the ventilating portion is preferably not to be formed near the portion to which the ground electrode is joined considering the heat conductivity of the ground electrode. Therefore, when the ventilating portion is formed along the circumferential direction of the cylindrical portion, the ventilating portion may be formed so that an opening area thereof is made gradually wider as it gets away from a junction with the ground electrode. Further, from a viewpoint of the cooling effect on the insulator, the ventilating portion having a wide opening area preferably faces the inlet of the combustion chamber when the spark plug is mounted on the internal combustion engine.

The invention claimed is:

1. A spark plug, comprising:

a center electrode;

an insulator having therein an axial bore that extends in an axis direction of the center electrode and accommodating the center electrode in the axial bore;

a metal shell surrounding and holding the insulator in a radial direction, said metal shell having a threaded portion for mounting the spark plug on a mounting portion of an internal combustion engine;

a cylinder-shaped cylindrical portion extending from the threaded portion of the metal shell toward a front end portion of the center electrode; and a ground electrode having one end joined to a front end of the cylindrical portion and another end disposed opposite to a front end portion of the center electrode to form a spark discharge gap therewith, wherein the insulator projects beyond the front end side of the cylindrical portion, wherein the cylindrical portion includes one or more ventilating portion which communicate with an inside and an outside of the cylindrical portion, said ventilating portion comprised of a notch.

2. A spark plug according to claim 1, wherein, in a first section (S) through a front end portion of the cylindrical portion, where section (S) is perpendicular to the axis direction, a length "W" connecting both ends of the notch is 0.7 L or more, where "L" is a diameter of the insulator in the first section (S).

3. A spark plug according to claim 1, wherein, in the first section (S) through the front end portion of the cylindrical portion, where section (S) is perpendicular to the axis direction, a sum of angles each formed between straight lines which connect each end of the notch to a center of the cylindrical portion, respectively, is smaller than a sum of angles each formed between straight lines which connect each end of the cylindrical portion to the center of cylindrical portion, respectively.

4. A spark plug according to claim 1, wherein the diameter "L" of the insulator in the first section (S) through the front end portion of the cylindrical portion, where section (S) is perpendicular to the axis direction that is shorter than the length "W" connecting both ends of the notch in the first section, and wherein a diameter "M" of the insulator in a second section through a rear end portion of the notch, said second section being perpendicular to the axis direction that is longer than a length "V" connecting both ends of the notch in the second section.

5. A spark plug, comprising:

a center electrode;

an insulator having therein an axial bore that extends in an axis direction of the center electrode, the center electrode being disposed in the axial bore;

a metal shell surrounding and holding the insulator in a radial direction, said metal shell having a threaded portion for mounting the spark plug on a mounting portion of an internal combustion engine;

a cylinder-shaped cylindrical portion formed extending from the threaded portion of the metal shell toward a front end portion of the center electrode; and a ground electrode having one end joined to a front end of the cylindrical portion and the other end disposed opposite to a front end portion of the center electrode to form a spark discharge gap therewith, wherein the cylindrical portion includes one or more ventilating portions which communicate with an inside and an outside of the cylindrical portion, said ventilating portion comprised of a through hole.

6. A spark plug according to claim 5, wherein the through hole has a length in the axis direction longer than a radial length thereof.

7. A spark plug according to claim 1, wherein the ventilating portion has the radial length on the rear end side shorter than the front end side.

8. A spark plug according to any one of claim 1 or 5, wherein a junction between the cylindrical portion and the ground electrode is away from a position for forming the ventilating portion in a circumferential direction of the cylindrical portion.

9. An internal combustion engine, comprising a spark plug according to any one of claim 1 or 5 and a mounting portion on which the spark plug is mounted.

10. An internal combustion engine according to claim 9, wherein the spark plug has the ventilating portion facing to an inlet of the internal combustion engine in a side face of the cylindrical portion when being mounted on the mounting portion.

* * * * *